US009868560B2

(12) United States Patent
Renard

(10) Patent No.: US 9,868,560 B2
(45) Date of Patent: Jan. 16, 2018

(54) TECHNICAL MARKING, IN PARTICULAR FOR A VEHICLE, PARTICULARLY FOR AIRCRAFT

(71) Applicant: DISATECH, Limoges (FR)

(72) Inventor: Christophe Renard, La Varenne Saint Hilaire (FR)

(73) Assignee: DISATECH, Limoges (FR)

( * ) Notice: Subject to any disclaimer, the term of this patent is extended or adjusted under 35 U.S.C. 154(b) by 802 days.

(21) Appl. No.: 13/939,495

(22) Filed: Jul. 11, 2013

(65) Prior Publication Data

US 2014/0014262 A1 Jan. 16, 2014

(30) Foreign Application Priority Data

Jul. 11, 2012 (FR) ..... 12 56693

(51) Int. Cl.
*B65C 9/26* (2006.01)
*B44C 1/17* (2006.01)
*B65C 9/36* (2006.01)

(52) U.S. Cl.
CPC ..... *B65C 9/262* (2013.01); *B44C 1/172* (2013.01); *B65C 9/36* (2013.01); *Y10T 156/17* (2015.01)

(58) Field of Classification Search
None
See application file for complete search history.

(56) References Cited

U.S. PATENT DOCUMENTS

| | | | | |
|---|---|---|---|---|
| 3,315,387 | A * | 4/1967 | Heuser | G09F 3/10 283/81 |
| 3,898,357 | A | 8/1975 | Miller et al. | |
| 6,626,183 | B1 | 9/2003 | Pietrocola et al. | |
| 2007/0001558 | A1 | 1/2007 | Fuller et al. | |
| 2007/0036929 | A1 | 2/2007 | Baird et al. | |
| 2007/0036950 | A1 * | 2/2007 | Dovellos | B42D 5/002 428/195.1 |
| 2008/0248297 | A1 | 10/2008 | Lee | |

OTHER PUBLICATIONS

French Search Report dated Apr. 22, 2013, corresponding to the Foreign Priority Application No. FR1256693.

* cited by examiner

*Primary Examiner* — Alexandre Ferre
*Assistant Examiner* — Elaine M Vazquez
(74) *Attorney, Agent, or Firm* — Young & Thompson

(57) ABSTRACT

Device for affixing a visual marking on a surface to be marked of a rigid support (1) that is ready for use, which comprises an assembly that is essentially inelastic, exhibits a certain degree of flexibility, forms a flat and thin cohesive multilayer stack that includes a protective back (6), a marked support (7), a stencil (8), and an application obverse (9), limited by a peripheral edge (22) with an adhesion of its rear face (23) and of the front face of the stencil (21) that can—during the use of the device (1)—allow the removal of the application obverse (9) by peeling.

20 Claims, 6 Drawing Sheets

TECHNICAL MARKING, IN PARTICULAR FOR A VEHICLE, PARTICULARLY FOR AIRCRAFT

BACKGROUND OF THE INVENTION

This invention relates to technical marking, in particular for a vehicle, and particularly for an aircraft or spacecraft.

It has as its first object a device for the affixing of a visual marking on a surface to be marked of a rigid support that is ready for use; for a second object a collection of such devices; for a third object a kit for the affixing of at least one visual marking on at least one surface to be marked of at least one rigid support comprising such a device; and for a fourth object a process for using such a device.

DESCRIPTION OF THE RELATED ART

It is known that an aircraft has on its fuselage and its wings a technical marking for purposes of identification, of use, of monitoring, of safety of the aircraft altogether or a technical marking of parts, sub-assemblies or assemblies. In the context of the invention, "marking" is defined as one or more marks such as a letter, a number, a symbol, a design . . . .

For a given aircraft, such markings are of a relatively large number, for example several tens. They are most often of a limited size, for example not exceeding on the order of ten centimeters. The markings are to be affixed on surfaces that are rigid, rather smooth, flat or most often slightly curved. These markings are to be affixed in very precise sites. In some cases, the sites have easy access, but in other cases, the sites have rather inconvenient access. These markings are affixed on the fuselage or the wings, even though the latter have been painted and, if appropriate, partially varnished. These markings must have a very slight thickness and be incorporated as closely as possible in the fuselage or in the wings so as to avoid any projection. These markings must be able to be applied quickly and with minimal risk of error. Finally, these markings are provided so as to be covered with one or more layers of varnish or the like.

SUMMARY OF THE INVENTION

The invention has as its object to propose a marking that addresses all of these requirements.

The document US 2007036929 describes a thin polymer film intended to be applied on an aircraft.

For this purpose, according to a first aspect, the invention has as its object a device for affixing a visual marking on a surface to be marked of a rigid support that is ready for use, which, in the ready-to-use state, comprises an assembly that is essentially inelastic, exhibits a certain degree of flexibility, forms a flat and thin cohesive multilayer stack that includes, from back to front:

- a protective back, limited by a peripheral edge, on the front face of which the multilayer stack is situated, which can be removed by peeling for the purpose of using the device,
- a thin, marked support, provided with the marking, limited by a peripheral edge located within the peripheral edge of the protective back, having an adhesive rear face that works with the front face of the protective back and that is able—during the use of the device—to ensure the bonding of the marked support on the surface to be marked,

- a stencil limited by a peripheral edge, having a window limited by an edge located beyond the peripheral edge of the marked support that is located opposite the window, having an adhesive rear face that works with the front face of the protective back and that is able, during the use of the device, to ensure first a certain degree of bonding of the stencil on the surface to be marked and then to allow the removal of the stencil by peeling,
- an application obverse, limited by a peripheral edge with an adhesion of its rear face and of the front face of the stencil that can, during the use of the device, allow the removal of the application obverse by peeling.

According to an embodiment, the peripheral edge of the protective back, the peripheral edge of the stencil, and the peripheral edge of the application obverse are at least approximately superposed by means of, if necessary, a peripheral peeling grip portion of the application obverse that is not covered by the stencil.

According to an embodiment, the protective back is essentially transparent, in particular essentially colorless, and/or the marked support is essentially transparent, in particular essentially colorless, allowing the marking that it comprises to show through, and/or the stencil is essentially transparent, in particular colored with a color other than the color of the marked support, and/or the application obverse is essentially transparent, in particular essentially colorless, and in which the stencil and/or the application obverse comprise signs of identification and/or of locating or positioning.

According to an embodiment, the protective back comprises one or more cut lines suitable for facilitating the peeling.

According to an embodiment, the protective back, the marked support, the stencil or the application obverse is formed by a layer or a group of layers of plastic material, if necessary with adhesive coating and/or in which the marking is performed on the marked support by printing with ink.

The device as just described can be in one of the intermediate states subsequent to the ready-to-use state, namely:

- a first state in which the protective back is separated from the marked support, from the stencil, and from the application obverse having been removed by peeling, while the marked support, the stencil, and the application obverse are joined,
- a second state in which the marked support and the stencil are joined with the surface to be marked, while the application obverse is joined with the marked support and with the stencil,
- a third state in which the marked support and the stencil are joined with the surface to be marked, while the application obverse is separated from the marked support and from the stencil having been removed by peeling,
- a fourth state in which the marked support and the stencil being joined with the surface to be marked and the application obverse separated, at least one protective varnish layer or the like covers the front face of the marked support, the area of the surface to be marked being situated in the window of the stencil and a part of the front face of the stencil adjacent to the edge.

The device as just described can be in the final state where the visual marking is affixed on the surface to be marked, in which the marked support is joined with the surface to be marked, and at least one protective varnish layer or the like covers the front face of the marked support and an area of the surface to be marked being situated around the marked support, while the protective back, the application obverse, and the stencil are separated.

According to a characteristic, the device as just described is especially intended for a surface to be marked of a vehicle, more especially an aircraft or spacecraft.

According to an embodiment, the marked support has a measurement whose largest size does not exceed 20 cm, more especially does not exceed 10 cm, the device having a largest size not exceeding 50 cm, more especially not exceeding 30 cm.

According to an embodiment, the peripheral edge of the protective back, the peripheral edge of the stencil, the peripheral edge of the application obverse, and the edge of the window have a contour of a general square or rectangular shape.

According to a second aspect, the invention has as its object a collection of devices for the affixing of visual markings that comprises a plurality of devices for the affixing of a visual marking on a surface to be marked of a rigid support as just described, said devices being arranged so as to form at least one page of devices placed side by side in lines and/or columns and separated from one another by breakaway lines.

According to a third aspect, the invention has as its object a kit for the affixing of at least one visual marking on at least one surface to be marked of at least one rigid support that, in the ready-to-use state, comprises:

- at least one device as just described or at least one collection of such devices as just described,
- at least one blade for applying such a device on the surface to be marked, the device being in a first state in which the protective back is separated from the marked support, from the stencil, and from the application obverse, having been removed by peeling, while the marked support, the stencil, and the application obverse are joined,
- protective varnish or the like able to cover the front face of the marked support and an area of the surface to be marked that is situated around the marked support.

According to an embodiment, the application blade comprises a body exhibiting a high rigidity so as to be able to be applied firmly on the surface to be marked and, if necessary, to assume the slight curvature of the latter, having a grip portion and on the other side an application edge and a felt-like application cover.

According to an embodiment, the felt-like application cover is mounted in a removable and replaceable way.

According to a characteristic, the kit as just described is especially intended for a surface to be marked of a vehicle, more especially an aircraft or spacecraft.

According to a fourth aspect, the invention has as its object a process for using a device as previously described, in which:

- a surface to be marked of a rigid support is available,
- a device for the affixing of a visual marking on a surface to be marked of a rigid support as previously described in the ready-to-use state is available,
- protective varnish or the like able to cover the front face of the marked support and an area of the surface to be marked being situated around the marked support are available,
- then, the protective back is separated from the marked support, from the stencil, and from the application obverse, while the marked support, the stencil, and the application obverse are joined,
- then, the marked support and the stencil are joined with the surface to be marked by pressure, while the application obverse is joined with the marked support and with the stencil,
- then, the application obverse is separated from the marked support and from the stencil, while the marked support and the stencil remain joined with the surface to be marked,
- then, the front face of the marked support is covered with at least one layer of protective varnish or the like, the area of the surface to be marked being situated in the window of the stencil and a part of the front face of the stencil adjacent to its edge,
- then, the stencil is separated from the surface to be marked,
- and thus it is obtained that the visual marking of the marked support is affixed on the surface to be marked, the marked support being joined with the surface to be marked and at least one layer of protective varnish or the like covering its front face and an area of the surface to be marked being situated around the marked support.

According to an embodiment, the marked support and the stencil are joined with the surface to be marked by pressure by means of an application blade.

According to a characteristic, the process is such that the surface to be marked is part of a vehicle, more especially an aircraft or spacecraft.

BRIEF DESCRIPTION OF THE DRAWING FIGURES

The figures of the drawings will now be briefly described.

DETAILED DESCRIPTION OF THE INVENTION

Figure 1:
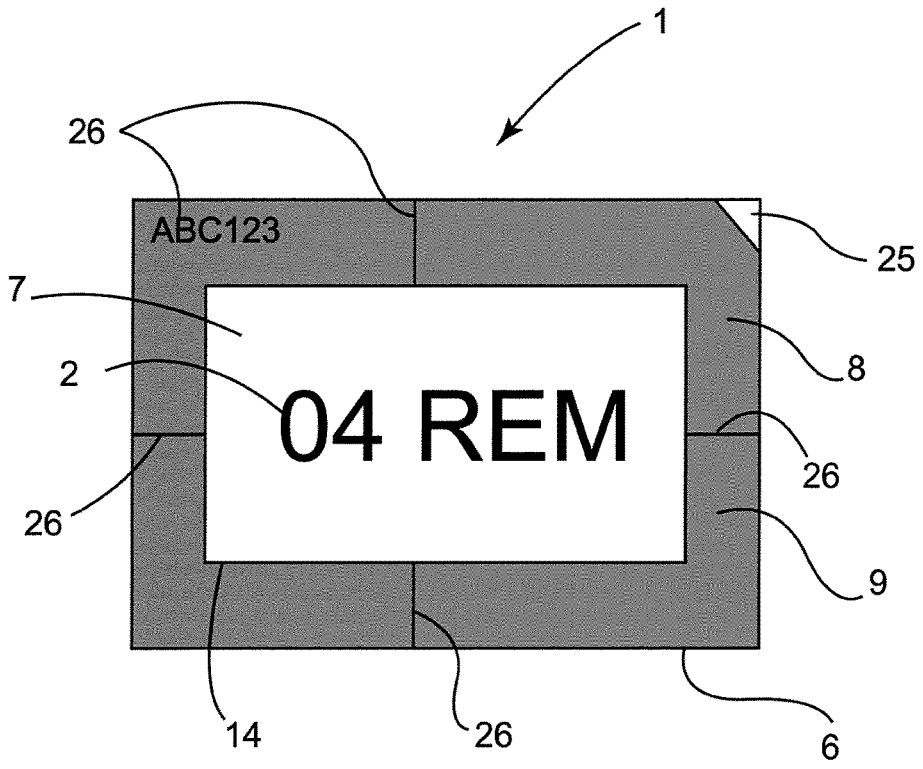
FIG. 1 is a front view of a device according to the invention for the affixing of a visual marking on a surface to be marked of a rigid support that is ready for use, which is in the ready-to-use state.
Figure 2:
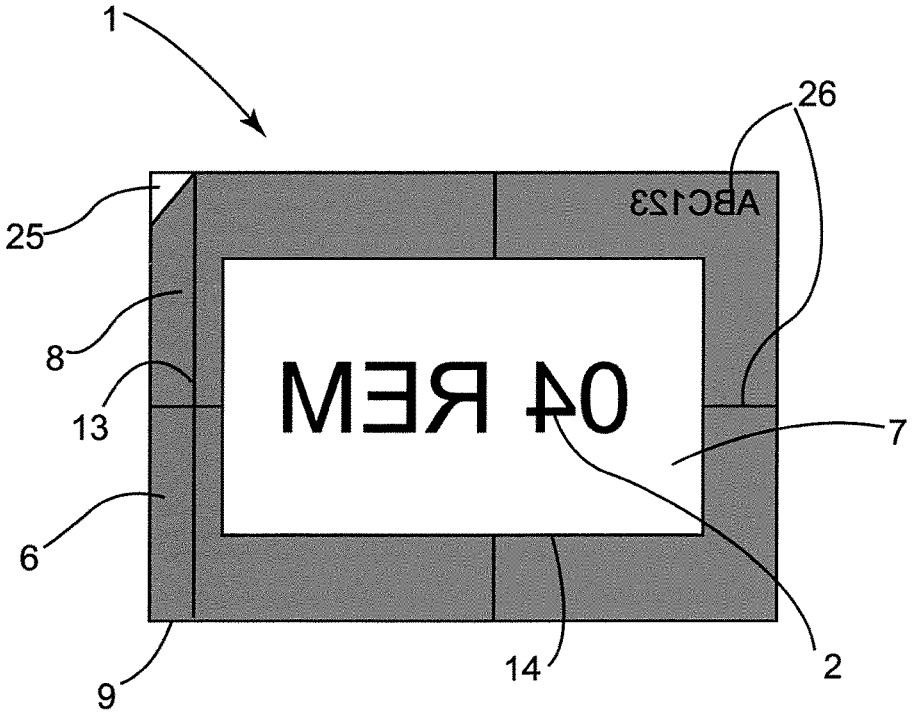
FIG. 2 is a rear view of the device of FIG. 1.
Figure 3:
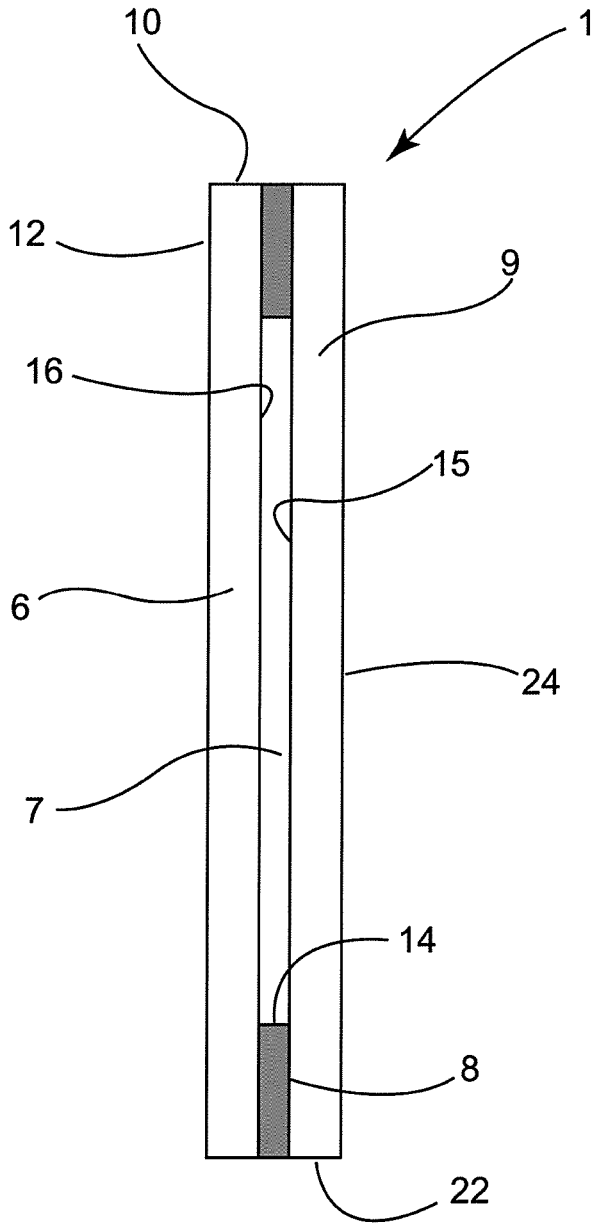
FIG. 3 is a view in cross-section on a larger scale of the device according to FIGS. 1 and 2.
Figure 4:
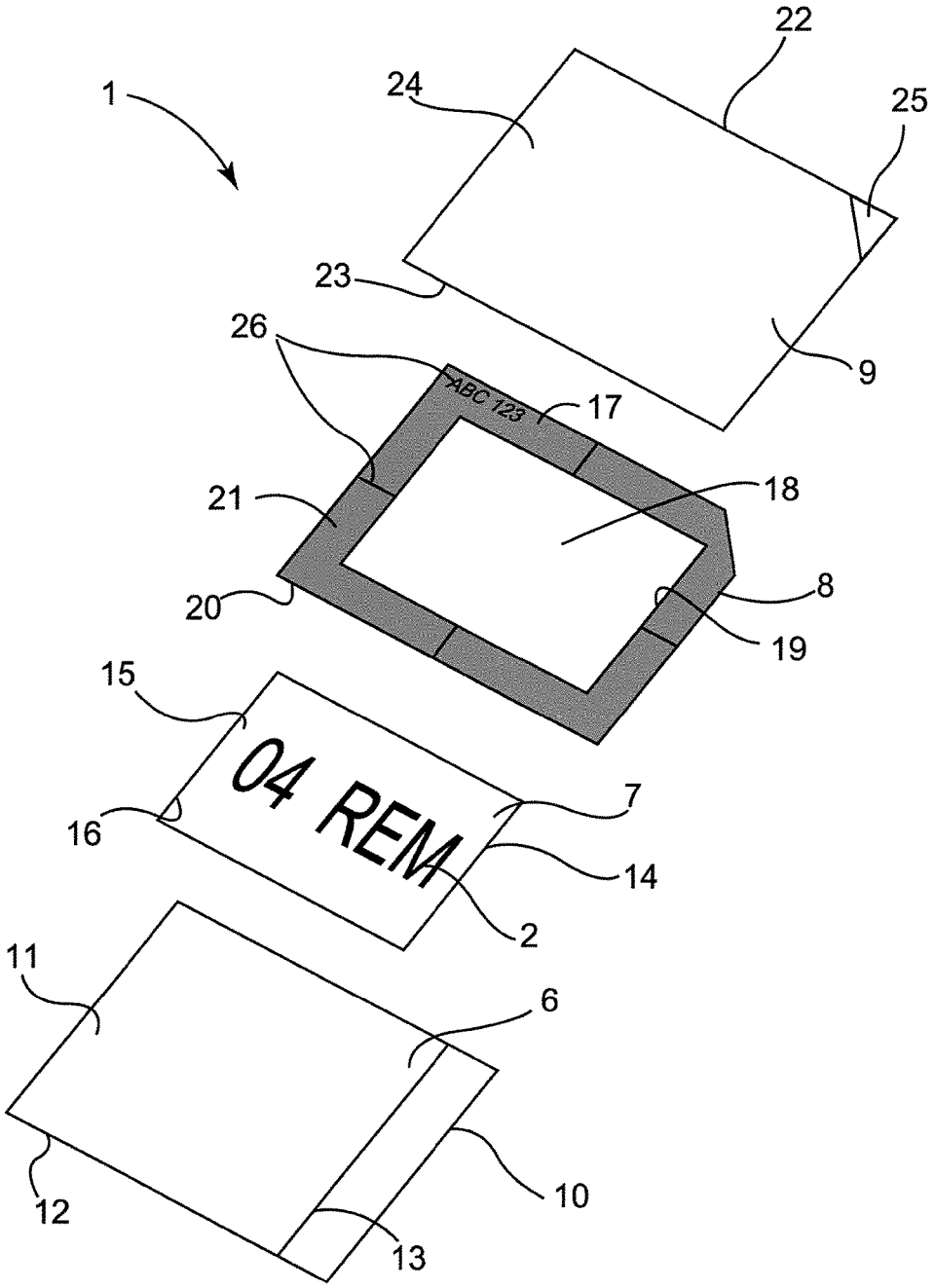
FIG. 4 is a view in perspective of the disassembled device according to FIGS. 1 to 3.
Figure 5:
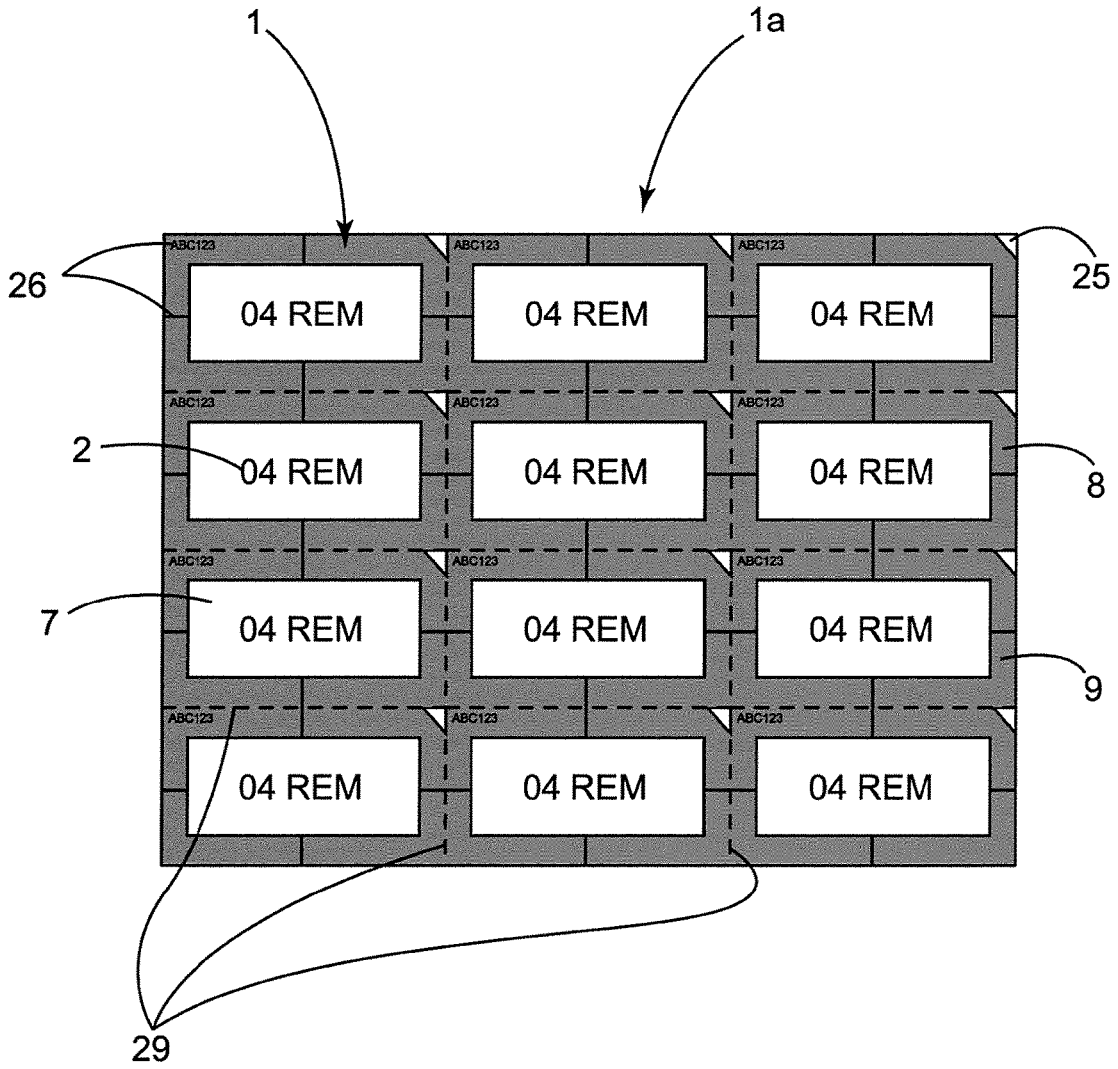
FIG. 5 is a front view of a collection of devices according to FIGS. 1 to 4.
Figure 6:
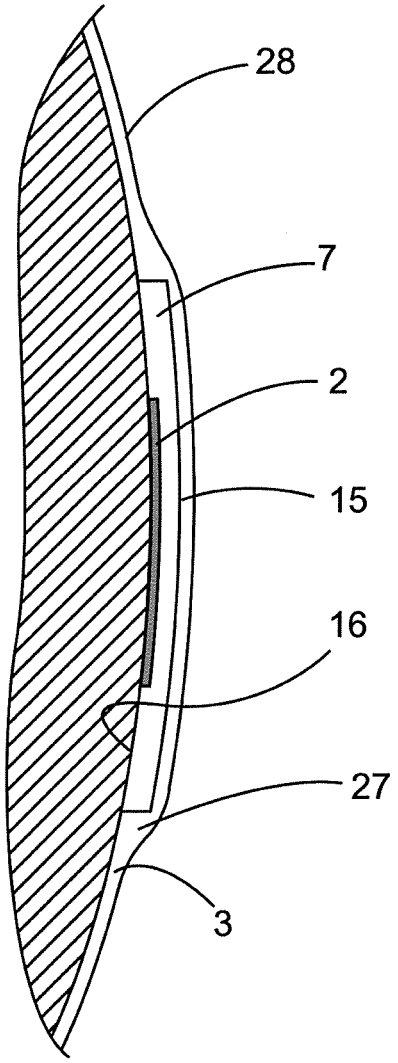
FIG. 6 is a view in cross-section illustrating a surface to be marked of a rigid support on which a marking is affixed by means of a device such as the one of FIGS. 1 to 4.
Figure 7:
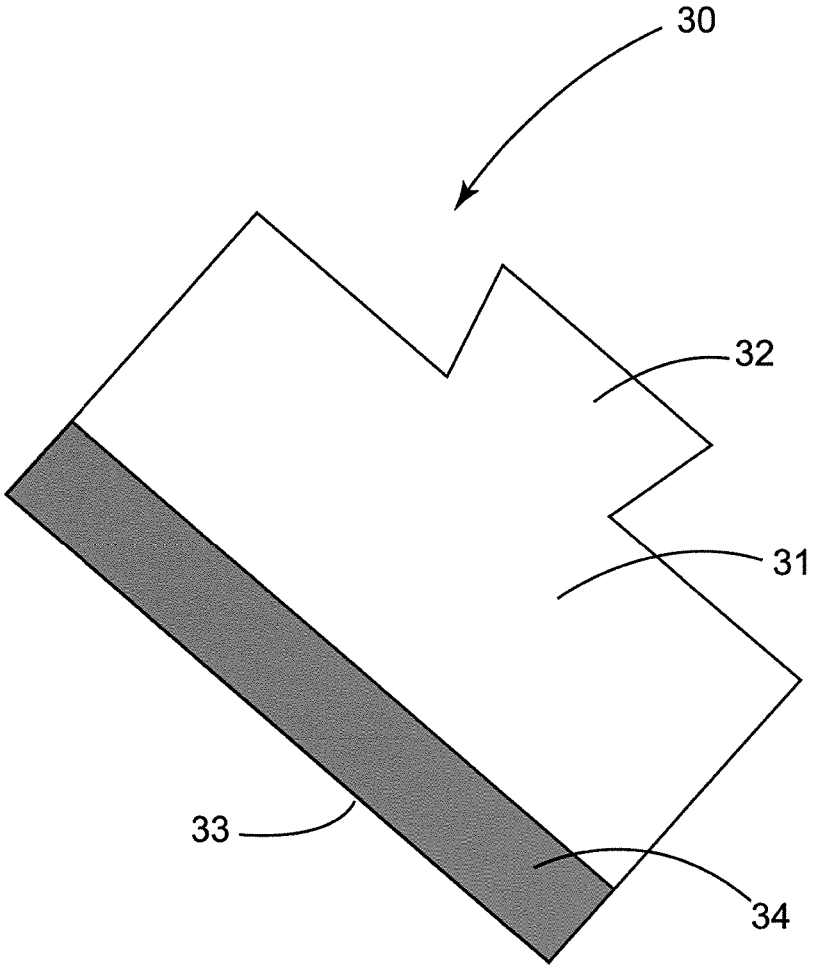
FIG. 7 is an elevation view of the application blade of the device.

Several embodiments of the invention are now described in detail by means of examples explained using the drawings and using the reference marks that appear in the drawings.

The invention has as its object, in particular, a device 1 for the affixing of a visual marking 2 in a very precise position on a surface 3 to be marked of a rigid support 4, this surface 3 being rather smooth, flat or slightly curved within the context of the invention.

The invention also has as its object a collection 1*a* of such devices 1, a kit for the affixing of a visual marking 2 comprising such a device 1 as well as, in particular, a blade 30 for applying such a device 1 on the surface 3 to be marked, and, finally, a process for using such a device 1.

The device 1 is ready for use, i.e., ready to use, so that, ultimately, the visual marking 2 is affixed on the surface 3 to be marked and is joined with the support.

The invention is especially intended for a surface 3 to be marked of a vehicle, more especially still, an aircraft or spacecraft. But, of course, it can be applied to other similar cases.

The visual marking 2 is intended for purposes of identification, of use, of monitoring, of safety. For an application such as a given aircraft, a relatively large number of markings 2, for example several tens of markings, are used. These markings 2 are different from one another and matched to their purpose. They are of a limited size, for example not exceeding on the order of ten centimeters.

Device 1, ready for use, comprises an assembly that is essentially inelastic, exhibits a certain degree of flexibility so as to be able to be applied on the surface 3 that can be slightly curved and used by means of a peeling curvature.

The device 1 comprises an assembly that forms a flat and thin cohesive multilayer stack.

"Assembly" is defined as the device that comprises several parts, as is described, but these parts work with one another.

"Multilayer stack" is defined as the device 1 that is formed by the superposition of its constituent parts. Of course, the device 1 can be in any position, so that the term "superposition" must not be considered as limiting to a particular position in space.

"Cohesive" is defined as the constituent parts of the device 1 that are ready for use, being held to each other, so that the device 1 can, for example, be maintained, handled and used. But, as is described, during its use, the device 1 is disassembled, its constituent parts being separated from one another.

"Flat" is defined as the device 1 being flat or curved, and without essential relief in any case.

"Thin" is defined as the device 1 having a thickness not exceeding a millimeter and even more specifically 0.5 mm, whereas its greatest size does not exceed 50 cm, more especially does not exceed 30 cm. For example, in an embodiment, the device 1 has a length and a width of between several centimeters and ten centimeters.

Consequently, it is understood that the device 1, when it is flat, appears as having two dimensions.

The multilayer stack includes, from back to front, a protective back 6, a marked support 7, a stencil 8, and an application obverse 9. In the embodiment shown in the drawings, the multilayer stack consists of the back 6, the support 7, the stencil 8, and the obverse 9. According to other embodiments, the device 1 can comprise one or more other layers.

One or the other of the protective back 6, the marked support 7, the stencil 8, and the application obverse 9 is formed by a layer or a group of layers made of plastic material, if necessary with adhesive coating.

"Rear" is defined as that which is posterior, in an absolute or relative way, i.e., that which is more distant from view when the device is viewed in a normal way. What is "rear" is toward, near, turned away from, or intended once the marking 2 is produced to be toward, near, or turned away from the surface 3 to be marked.

"Front" is defined as that which is opposite the rear.

The protective back 6 is limited by a peripheral edge 10. It comprises, on the one hand, a front face 11 where there is a multilayer stack, and, on the other hand, a rear face 12 that is one of the two open faces of the device 1.

The protective back 6 is able to be removed by peeling for the purpose of using the device 1.

The protective back 6 can comprise one or more cut lines 13, suitable for facilitating the peeling.

The marked support 7 is thin. It is provided with the marking 2 that is made by printing with ink.

The marked support 7 is limited by a peripheral edge 14 that is located within the peripheral edge 10 of the protective back 6, so that a part of the front face 11 of the protective back 6 goes all around beyond the peripheral edge 14 of the marked support 7, which is thus located in the central area of the protective back 6.

In an embodiment, the marked support 7 has dimensions whose largest size does not exceed 20 cm, more especially does not exceed 10 cm.

The marked support 7 has, on the one hand, a front face 15 and, on the other hand, a rear face 16, adhesive, so as to work with the front face 11 of the protective back 6. This rear face 16 is able—during the use of the device 1—to ensure the bonding of the marked support 7 on the surface 3 to be marked, this bonding being permanent.

The stencil 8 is limited by a peripheral edge 17.

The stencil 8 comprises a window 18 (absence of material) located in its middle part.

The window 18 is limited by an edge 19.

The edge 19 is located beyond the peripheral edge 14 of the marked support 7.

Thus, the marked support 7 is located opposite the window 18.

The stencil 8 has, on the one hand, an adhesive rear face 20 and, on the other hand, a front face 21.

The rear face 20 of the stencil 8 is adhesive. It works with the front face 11 of the protective back 6, and it is able—during the use of the device 1—to ensure first a certain degree of bonding of the stencil 8 on the surface 3 to be marked, and then to allow the removal of the stencil 8 by peeling, by means of a certain curvature and a manual pulling.

The application obverse 9 is limited by a peripheral edge 22.

The application obverse 9 has, on the one hand, a rear face 23 and, on the other hand, a front face 24 that is the other of the two open faces of the device 1.

An adhesion of the rear face 23 of the application obverse 9 and of the front face 21 of the stencil 8 is provided such that during the use of the device 1, the removal of the application obverse 9 is permitted by peeling.

For example, the rear face 23 of the obverse application 9 is adhesive, while the front face 21 of the stencil 8 has no adhesive, which could be troublesome in the use of the device 1.

When two faces of the device 1 are able to allow, at the same time, a mutual cooperation by adhesion and, when desired during the use of the device 1, a separation or removal by peeling, the adhesive used is selected accordingly.

In the embodiment shown in the drawings, the peripheral edge 10 of the protective back 6, the peripheral edge 17 of the stencil 8 and the peripheral edge 22 of the application obverse 9 are approximately superposed so as to form the peripheral edge 10, 17, 22 of the device 1.

However, a peripheral, peeling grip portion 25 of the application obverse 9 is provided that is not covered by the stencil 8. This peeling grip portion 25 is, for example, located in a corner.

In the embodiment shown in the drawings, the peripheral edge 10 of the protective back 6, the peripheral edge 17 of the stencil 8, and the peripheral edge 22 of the application obverse 9 and the edge 19 of the window have a contour of a general square or rectangular shape.

In the embodiment shown in the drawings, the protective back 6 is essentially transparent and in particular essentially colorless. The marked support 7 is itself also essentially transparent and in particular essentially colorless, it being understood that it comprises the marking 2 that is visible and particularly of a color such as black, red or yellow. The stencil 8 is itself also essentially transparent. But, in contrast with the marked support 7, the stencil 8 is colored, more generally with a color other than the color of the marked support 7. For example, the stencil 8 is slightly blue-tinted. Finally, the application obverse 9 is itself also essentially transparent and in particular essentially colorless. This design arrangement makes it possible to suitably position the device 1 on the surface 3 to be marked, and to see the surface 3 to be marked through the device, except of course, at the location of the marking, and to detect possible application imperfections of the device 1 on the surface 3 to be marked, such as folds or trapped air bubbles.

Furthermore, the stencil 8 and/or the application obverse 9 comprise signs 26 for identification and/or for locating or positioning. In the embodiment shown in the drawings, these signs 26 are provided on the application obverse 9 that also serves as positioning obverse 9.

The device 1 that is ready for use that has the structure described can be maintained and handled, remaining assembled.

The device 1 that is ready for use that has the structure described can, furthermore, be used at any desired time according to needs, so long as a surface 3 to be marked is available.

During this use, the device 1 is disassembled, its constituent parts being separated from one another. In this process of using the device 1, the latter, more or less disassembled, can be found in one of several intermediate states subsequent to the ready-to-use state and prior to the final state where the visual marking 2 is affixed on the surface 3 to be marked.

These intermediate states are successively the following.

In a first state, the protective back 6 is separated from the marked support 7, from the stencil 8, and from the application obverse 9. In fact, it has been removed by peeling, while the marked support 7, the stencil 8, and the application obverse 9 are still joined, bonded, between themselves.

In a second state, the marked support 7 and the stencil 8 are joined, bonded, with the surface 3 to be marked, while the application obverse 9 is joined, bonded, with the marked support 7 and with the stencil 8.

In a third state, the marked support 7 and the stencil 8 are joined, bonded, with the surface 3 to be marked, while the application obverse 9 is separated from the marked support 7 and from the stencil 8 having been removed by peeling. In this state, the marked support 7 is entirely located within the window 18 of the stencil 8, the marked support 7 and the stencil 8 being separated from one another, while leaving uncovered a ring-shaped area 27 of the surface 3 to be marked.

In a fourth state, the marked support 7 and the stencil 8 being joined, bonded, with the surface 3 to be marked and the application obverse 9 being separated, at least one protective varnish layer 28 or the like covers the front face 15 of the marked support 7, the area 27 of the surface 3 to be marked being situated in the window 18 of the stencil 8 and a part of the front face 21 of the stencil 8 adjacent to the edge 19.

Furthermore, the device 1 can be in the final state where the visual marking 2 is affixed on the surface 3 to be marked.

In this final state, the marked support 7 is joined, bonded, with the surface 3 to be marked, and there at least one protective varnish layer 28 or the like covers the front face 15 of the marked support 7 and the area 27 of the surface 3 to be marked, while the protective back 6, the application obverse 9, and the stencil 8 are separated and thrown away, no longer having any use.

According to a further enhancement of the invention, a collection 1*a* of devices 1 is provided, where these devices are arranged so as to form at least a page of devices 1 placed side by side in lines and/or columns and separated from one another by breakaway lines 29. According to the embodiments, the devices 1 on the same page exhibit the same marking 2 or else, in contrast, they exhibit different markings corresponding to, for example, the same area of the surface 3 to be marked.

According to a development of the invention, it is provided that a device 1 or a collection 1*a* of devices 1 is part of a kit for the affixing of at least one, and generally a plurality of, visual markings 2 on at least one, and generally a plurality of, surfaces 3 to be marked of one or several supports.

In the ready-to-use state, such a kit comprises at least one application blade 30 in addition to the device 1 or the collection 1*a* of devices 1.

This blade 30 is intended for the application of the device on the surface 3 to be marked while it is found in the first intermediate state that has been described.

Such a kit also comprises protective varnish or the like that can produce the layer 28.

According to an embodiment, the blade 30 comprises a body 31 exhibiting a high rigidity so as to be able to be applied firmly on the surface 3 to be marked and, if necessary, to assume the slight curvature of it. This body 31 has a grip portion 32 and an application edge 33 on the other side. The blade 30 also has a felt-like application cover 34 that can be mounted in a removable and replaceable way at the location of the application edge 33, so as not to damage the surface 3 to be marked nor the device 1.

Concerning the process of using the device 1, there is available a surface 3 to be marked of a rigid support, a device 1 in the ready-to-use state, and protective varnish or the like to form the layer 28.

Then, the protective back 6 is separated from the marked support 7, from the stencil 8, and from the application obverse 9, while the marked support 7, the stencil 8, and the application obverse 9 remain joined (first intermediate state).

Then, the marked support 7 and the stencil 8 are joined to the surface 3 to be marked by pressure, in particular with the blade 30, while the application obverse 9 is joined with the marked support 7 and with the stencil 8 (second intermediate state).

Then, the application obverse 9 of the marked support 7 and of the stencil 8 are separated, while the marked support 7 and the stencil 8 remain joined with the surface 3 to be marked (third intermediate state).

Then, the front face 15 of the marked support 7 is covered with the protective varnish layer or the like 28, the area 27 of the surface 3 to be marked being situated in the window 18 of the stencil 8 and a part of the front face 21 of the stencil 8 adjacent to its edge 19 (fourth intermediate step).

Then, the stencil 8 is separated from the surface 3 to be marked, by peeling, and thus the final state is reached where the visual marking 2 of the marked support 7 is affixed on the surface 3 to be marked, whereas the marked support 7 is joined to the surface 3 to be marked and whereas the protective varnish layer or the like 28 covers the front face 15 of the marked support 7 and the area 27 of the surface 3 to be marked around the marked support 7.

The invention claimed is:

1. A device for affixing a visual marking on a surface to be marked (3) of a rigid support (1) that is ready for use, which, in the ready-to-use state, comprises an assembly that is essentially inelastic, exhibits a certain degree of flexibility, forms a flat and thin cohesive multilayer stack that includes, from back to front:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling.

2. Device (1) according to claim 1, in which the peripheral edge of the protective back (10), the peripheral edge of the stencil (17), and the peripheral edge of the application obverse (22) are superposed.

3. Device (1) according to claim 1, at least one of the group consisting of the protective back (6), the marked support (7), the stencil (8), and the application obverse (9) is essentially transparent.

4. Device (1) according to claim 3, wherein at least one of the group consisting of the stencil (8) and the application obverse (9) comprise signs of identification, locating, and positioning (26).

5. Device (1) according to claim 3, wherein the protective back (6) comprises one or more cut lines (13) suitable for facilitating the peeling.

6. Device (1) according to claim 3, wherein, at least one of the group consisting of the protective back (6), the marked support (7), and the application obverse (9) is essentially colorless.

7. Device (1) according to claim 6, wherein at least one of the group consisting of the stencil (8) and the application obverse (9) comprise signs of identification, locating, and positioning (26).

8. Device (1) according to claim 1, in which the protective back (6), the marked support (7), the stencil (8), or the application obverse (9) is formed by a layer or a group of layers made of plastic material, with adhesive coating and/or in which the marking (2) on the marked support (7) is an ink print.

9. A device for the affixing of a visual marking on a surface to be marked (3) of a rigid support (1) that is ready for use, which, in a first state, comprises:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling, and in which the protective back (6) is separated from the marked support (7), from the stencil (8), and from the application obverse (9) having been removed by peeling, while the marked support (7), the stencil (8), and the application obverse (9) are joined, forming a flat and thin cohesive multilayer stack, which is essentially inelastic, exhibiting a certain degree of flexibility, including, from back to front, the marked support (7), the stencil (8), and the application obverse (9).

10. A device for the affixing of a visual marking on a surface to be marked (3) of a rigid support (1) that is ready for use, which, in a second state, comprises:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling, and in which the marked support (7) and the stencil (8) are joined with the surface to be marked (3), while the application obverse (9), the marked support (7), and the stencil (8) are joined, forming a flat and thin cohesive multilayer stack, essentially inelastic, exhibiting a certain degree of flexibility, including, from back to front, the marked support (7), the stencil (8), and the application obverse (9).

11. A device for the affixing of a visual marking on a surface to be marked (3) of a rigid support (1) that is ready for use, which, in a third state, comprises:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling, and in which the marked support (7) and the stencil (8) are joined with the surface to be marked (3), while the application obverse (9) is separated from the marked support (7) and from the stencil (8) having been removed by peeling, the marked support (7) and the stencil (8), joined, forming a flat and thin cohesive multilayer stack, essentially inelastic, exhibiting a certain degree of flexibility, including, from back to front the marked support (7), and the stencil (8).

12. A device for the affixing of a visual marking on a surface to be marked (3) of a rigid support (1) that is ready for use, which, in a fourth state, comprises:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located within the peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) limited by an edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear adhesive (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling, and wherein the marked support (7) and the stencil (8) are joined with the surface to be marked (3), while the application obverse (9) is separated, at least one layer of protective varnish (28) or the like covering the front face of the marked support (15), the area of the surface to be marked (3) being situated in the window of the stencil (18) and a portion of the front face of the stencil (21) adjacent to the edge (19).

13. A device for the affixing of a visual marking on a surface to be marked (3) of a rigid support (1) that is ready for use, which, in the final state, comprises:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the outer peripheral edge (17) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling, where the visual marking (2) is affixed on the surface to be marked (3), the marked support (7) joined with the surface to be marked (3), and at least one protective layer of varnish (28) or the like covering the front face of the marked support (15), and an area of the surface to be marked (3) being situated around the marked support (7), while the protective back (6), the application obverse (9), and the stencil (8) are separated.

14. A device for affixing a visual marking on a surface to be marked (3) of a rigid support (1) that is ready for use, which, in the ready-to-use state, comprises an assembly that is essentially inelastic, exhibits a certain degree of flexibility, forms a flat and thin cohesive multilayer stack that includes, from back to front:

a protective back (6) having an exterior perimeter delimited by an outer peripheral edge (10), the protective back (6) having an area and a front face (11) on which a remainder of the multilayer stack is situated, which can be removed by peeling for the purpose of using the device, a thin, marked support (7), provided with the marking (2), the marked support (7) having an exterior perimeter delimited by an outer peripheral edge (14), wherein the outer peripheral edge (14) of the marked support (7) is spaced apart from and located entirely within the outer peripheral edge of the protective back (6) and an area of the marked support (7) is less than the area of the protective back (6), the marked support (7) having an adhesive rear face (16) that works with the front face of the protective back (11) and that is able—during the use of the device—to ensure the bonding of the marked support (7) on the surface to be marked (3), a stencil (8) limited by an outer peripheral edge (17) and an inner peripheral edge (19), the stencil (8) having a window (18) delimited by the inner edge (19) located beyond the outer peripheral edge (14) of the marked support (7), the window (18) being an opening absent of material within the stencil (8), the marked support (7) being located entirely within and surrounded by the window (18) with the outer peripheral edge (14) of the marked support (7) being spaced apart from and located entirely within the inner peripheral edge (19) of the stencil (8), the stencil (8) having an adhesive rear face (20) that works with the front face of the protective back (11) and that is able—during the use of the device (1)—to ensure first a limited degree of bonding of the stencil (8) on the surface to be marked (3) when the adhesive rear face (16) of the marked support (7) is bonding the marked support (7) on the surface to be marked (3), and then with the marked support (7) bonded on the surface to be marked (3), the adhesive rear face (20) allowing the removal of the stencil (8) by peeling, and an application obverse (9), delimited by an outer peripheral edge (22), the application obverse (9) having a rear face (23) with an adhesion located against the front face of the stencil (21), the adhesion on the rear face (23) of the application obverse (9) allowing—during the use of the device (1)—removal of the application obverse (9) by peeling.

15. Collection of devices (1*a*) for the affixing of visual markings that comprises a plurality of devices (1) for the affixing of a visual marking on a surface to be marked of a rigid support, in which the peripheral edge of the protective back (10), the peripheral edge of the stencil (17), the peripheral edge of the application obverse (22), and the edge of the window (19) have a contour of a general square or rectangular shape, said devices being arranged so as to form at least one page of devices (1) placed side by side in lines and/or columns and separated from one another by breakaway lines (29).

16. Kit for the affixing of at least one visual marking (2) on at least one surface to be marked (3) of at least one rigid support that, in the ready-to-use state, comprises:

at least one device (1) according to claim 1, at least one blade (30) for applying on the surface to be marked (3) of such a device (1) being in a first state in which the protective back (6) is separated from the marked support (7), from the stencil (8), and from the application obverse (9), having been removed by peeling, while the marked support (7), the stencil (8), and the application obverse (9) are joined, protective varnish (28) or the like able to cover the front face of the marked support (15) and an area of the surface to be marked (3) that is situated around the marked support (7).

17. Kit according to claim 16, in which the application blade (30) has a body (31) exhibiting a high rigidity so as to be able to be applied firmly on the surface to be marked (3) and, if necessary, to assume the slight curvature of the latter, having a grip portion (32) and on the other side an application edge (33) and a felt-like application cover (34), in particular with a felt-like application cover (34) that is mounted in a removable and replaceable way.

18. Process for using a device (1) according to claim 1, in which:

a surface to be marked (3) of a rigid support is available, a device (1) for the affixing of a visual marking (2) on a surface to be marked (3) of a rigid support in the ready-to-use state is available, protective varnish (28) able to cover the front face of the marked support (15) and an area of the surface to be marked (3) being situated around the marked support (7) is available, then, the protective back (6) is separated from the marked support (7), from the stencil (8), and from the application obverse (9), while the marked support (7), the stencil (8), and the application obverse (9) are joined, then, the marked support (7) and the stencil (8) are joined with the surface to be marked (3) by pressure, while the application obverse (9) is joined with the marked support (7) and with the stencil (8), then, the application obverse (9) is separated from the marked support (7) and from the stencil (8), while the marked support (7) and the stencil (8) remain joined with the surface to be marked (3), then, the front face of the marked support (15) is covered with at least one layer of protective varnish (28), the area of the surface to be marked (3) being situated in the window of the stencil (18) and a portion of the front face of the stencil (21) adjacent to its edge, then, the stencil (8) is separated from the surface to be marked (3), and thus it is obtained that the visual marking (2) of the marked support (7) is affixed on the surface to be marked (3), the marked support (7) being joined with the surface to be marked (3), and at least one layer of protective varnish (28) covering its front face (15) and an area of the surface to be marked (3) being situated around the marked support (7).

19. Process according to claim 18, in which the marked support (7) and the stencil (8) are joined with the surface to be marked (3) by pressure by means of an application blade (30).

20. Process according to claim 18, in which the surface to be marked (3) is part of a vehicle.

* * * * *